United States Patent [19]

Kuehnle et al.

[11] 4,242,433

[45] Dec. 30, 1980

[54] HIGH SPEED ELECTROPHOTOGRAPHIC MEDIUM

[75] Inventors: Manfred R. Kuehnle, Lexington; Arno K. Hagenlocher, Framingham, both of Mass.

[73] Assignee: Coulter Systems Corp., Bedford, Mass.

[21] Appl. No.: 851,822

[22] Filed: Nov. 16, 1977

Related U.S. Application Data

[62] Division of Ser. No. 796,054, May 12, 1977, Pat. No. 4,155,640.

[51] Int. Cl.[2] ..... G03G 5/04

[52] U.S. Cl. ..... 430/67; 430/66; 430/55; 355/3 R

[58] Field of Search ..... 96/1 R, 1.5, 1.1; 430/67

[56] References Cited

U.S. PATENT DOCUMENTS

| | | | |
|---|---|---|---|
| 2,825,814 | 3/1958 | Walkup | 427/19 |
| 3,308,233 | 3/1967 | Button et al. | 96/1 R |
| 3,322,538 | 5/1967 | Redington | 96/1 TE |
| 3,350,610 | 10/1967 | Yamashita | 96/1.5 R |
| 3,438,706 | 3/1969 | Tanaka et al. | 96/1 R |
| 3,649,116 | 3/1972 | Hall | 96/1 R |
| 3,716,359 | 2/1973 | Sheridon | 96/1.1 |
| 3,973,956 | 8/1976 | Kuehnle | 96/1 R |
| 4,014,697 | 3/1977 | Schmidlen | 96/1.4 |
| 4,025,339 | 5/1977 | Kuehnle et al. | 96/1.5 |

OTHER PUBLICATIONS

Nakamura, "PIP And Electrophotography", Denshi Shashin, 4, No. 3, pp. 12–17 (1962).

*Primary Examiner*—Roland E. Martin, Jr.
*Attorney, Agent, or Firm*—I. Irving Silverman

[57] ABSTRACT

Electrophotographic medium which comprises a multilayer structure of materials for imaging radiant energy patterns at high speed and with high sensitivity of a degree capable of meeting and exceeding the sensitivity of silver halide film, with greater resolution than that of silver halide film of the high speed type.

A method of using electrophotographic film to achieve high sensitivities and speeds.

The medium comprises a transparent substrate, ohmic layer and coating of photoconductive material, all of which form a modulating structure for the radiant energy that is adapted to be projected through the substrate; a dielectric layer intimately bonded to the surface of the photoconductive coating and a conductive electrode in intimate contact with the dielectric layer.

The use of the electrophotographic medium does not require initial charging; hence no means for effecting this are required. Further, the speed of the medium is so high compared with all other media that extremely low energy levels can provide sufficient contrast to produce images.

The structure as described is used by connecting a d.c. voltage across the outer electrode and the ohmic layer and projecting the image onto the medium from what would be considered the bottom surface of the substrate. The charge image appears on the dielectric layer. The information represented by the latent change image is utilized by reading the same out with an electron beam or by toning and/or fixing and transfer.

11 Claims, 7 Drawing Figures

HIGH SPEED ELECTROPHOTOGRAPHIC MEDIUM

This is a division of application Ser. No. 796,054 filed May 12, 1977 now U.S. Pat. No. 4,155,640.

BACKGROUND OF THE INVENTION

Silver halide film achieves its great speed in the case of the high speed variety by the process of development. The chemical reactions occurring in the development baths enable the achievement of ASA ratings which are of the order of hundreds. Known electrophotographic media are much slower in speed than silver halide film because the latent image, when formed electrostatically, cannot be improved by further processing. This latent image is not a chemical image but is a latent charge image, being electrostatic; hence its character is established by the electrical properties of the medium and the phenomenon which produced the image, i.e. light etc.

Although a true comparison of speed between silver halide film and an electrophotographic film cannot actually be made on the basis of A.S.A. or Din. ratings, due to the definition of A.S.A. rating, some general or roughly quantitative measure can be discussed. As stated, A.S.A. ratings of silver film can extend from tens or twenties to as high as several hundred and even as high as 1000 for special film. Even low A.S.A. film can be processed in such a manner as to change its initial A.S.A. rating upward by a multiple of ten or twenty. It can be said generally that the higher the speed of silver halide film, the coarser the grain. This comment should be kept in mind in view of description of the electrophotographic medium which will be given below, since, resolution of an image on silver halide film depends upon the size of the grains of silver produced in the emulsion during development.

The known methods of electrophotography depend upon (a) charging a photoconductor surface, (b) selectively discharging the surface by means of a light or other radiant energy pattern and (c) toning to develop the latent charge image. Instead of toning, in the case of a certain type of electrophotographic film which is disclosed in U.S. Pat. No. 4,025,339, the latent image may be read out by an electronic beam. The speed and sensitivity of a given electrophotographic medium is related to the ability of the photoconductor to accept and retain a charge and its ability to discharge selectively in response to light, for example. These characteristics are inherent in the constitution of the photoconductor and its method of manufacture.

Once the latent charge image has been established on the photoconductor the duration of the image will depend upon the ability of the photoconductive layer or coating to resist self-discharge. This ability is described by the dark decay characteristics of the photoconductor.

It has been known that a dielectric coating on a photoconductive medium will provide greater contrast than the same photoconductive medium without such coating and will enable longer retention of the latent image produced during exposure as taught, for example, by the Canon NP process ("Canography [Canon NP Process] in Electrophotography" by Matao J. Mitsui, IEEE Transactions in Electron Devices, Vol ED-19, No. 4, April 1972, pages 396–404). So far as known there has been no commercially successful medium which does not require the charging of the medium before its exposure. The inconvenience of the added step of charging and the expense of the accompanying requirement for apparatus to effect the charge when compared with a process that requires no charging are obviously great disadvantages.

It has been suggested to transfer the image from a photoconductive layer to an insulating layer but in those instances the voltage which has been available for generating the latent image has been only the charge applied before imaging and retained on the medium. In other words the medium must be charged before imaging.

There is one method of imaging which does not require prior charging but which has other advantages that have been eliminated by the invention in an unobvious manner. This method is detailed in the reference "Electrophotography" by Schaffert, The Focal Press, London, 1975, pages 172 and following.

In Schaffert reference is made to a technique in which electrostatic images are produced on the surface of a dielectric film member while the dielectric member is in contact with a xerographic member. U.S. Pat. No. 2,825,814 to Walkup is mentioned as the origin of the technology. The assembly of layers comprises a photoconductive layer on a conductive substrate such as metal or NESA glass which is transparent. The dielectric film member with a conductive backing such as a transparent metallic coating is placed in contact with the surface of the photoconductive layer. A high voltage of order of several thousand volts is applied between the conductive base of the photoconductive layer and the electrode. Simultaneously an optical image is projected onto the assembly, either through the back or front - whichever is transparent. According to the disclosure, after the brief exposure to light and the electric potential the light is turned off and the dielectric member separated from the photoconductor surface, the applied electric potential being maintained while this occurs.

The disclosure of the above identified publication recognizes that there is an advantage to this process because the dark decay characteristic of the photoconductor need not be as great as in the case where it must be charged initially, exposed and then be required to retain the charge.

So far as known, no technique of this type has been embodied in a commercial device. It is quite clear that there are several very important disadvantages to the technique and the structure which militate against the possibility of achieving practical results:

A. The use of high voltage. Keeping a voltage of several thousand volts applied to members which are to be used as described in dangerous and leads to the need for expensive equipment and insulation materials.

B. The separation of the dielectric layer. Even at low voltages, stripping off a sheet member such as dielectric film is certain to produce breakdown of the gap and thereby deteriorate the latent image on the photoconductor and/or dielectric member.

C. The presence of the air gap. The bringing together of the dielectric member and the photoconductor cannot help but produce an air gap, as indicated in the prior art disclosure. The charges from the photoconductor must therefore cross the air gap in order to settle onto the dielectric member. It is impossible for the air gap to be absolutely uniform as a result of which the transfer is uneven. There will be loss in the transfer because of the air gap in addition to unevenness.

According to this invention there is a constant voltage available which is independent of the surface potential of the photoconductive member, as required in other electrophotographic media, the constant voltage being applied between the ohmic layer and the surface electrode so that in effect the act of exposure enables the photoconductive layer to modulate the movement of carriers. The current source represented by the power supply furnishes large amounts of carriers for transport, millions of times more than would be available from usual techniques of charge and discharge by exposure to radiant energy. Furthermore, the voltage which need be used in the invention is substantially less than 100 volts, which is in contrast with the prior art technique described in the Schaffert publication that must use several thousands of volts.

In any system which attempts to utilize an electrode and a dielectric layer, the electrode and layer must be intimately connected and the dielectric layer must be intimately connected with the photoconductive surface. Any spacing or gap produces discontinuities and unevenness. Furthermore, stripping the dielectric layer off the photoconductive layer after imaging produces sparking or corona discharge and destroys the latent image or deteriorates the same. If the dielectric layer is bonded to the photoconductive surface, one must remove the electrode which means that the electrode must be removable, hence will give rise to a gap between electrode and dielectric during imaging. The disadvantages of this, as stated, are nonuniformity in charge distribution and likelihood of breakdown as well.

Applicants are aware of the work of H. Kiess of Zurich, Switzerland who conducted experiments in an attempt to increase the sensitivity of Electrophotographic media. Kiess used an assembly consisting of a photoconductive member which he describes as "prepared CdSe layers" and CdSe single crystals, but without further details, mounted on a grounding member and having an insulating film mounted thereon with a volatile conducting fluid serving as the electrode on top of the insulating film. Kiess charged the photoconductive layer and then brought his insulating film against the photoconductive surface to induce an image of the latent image from the photoconductor onto the insulating film. The volatile conducting fluid is connected to the grounding member to effect the transfer of charge to the insulating film without external application of voltage. When the volatile liquid evaporates, the film is stripped off the photoconductive layer. Then the insulating film can be toned to develop the image. Kiess succeeded, according to his report, to store images for several months before there was substantial loss in total surface charge. He claims to have achieved A.S.A. ratings of the order of 100 with some samples going as high as 300 A.S.A.

The invention obviates the need for pre-charging; eliminates the requirement to separate any layer from another to provide for development of the latent image; eliminates the problems of connecting the electrode in place and disconnecting it; eliminates all gaps either between the electrode and dielectric layer or between the dielectric layer and the photoconductive surface.

The speed and sensitivities of prior electrophotographic media, including the experimental ones described, are so low that the ability of the media to be exposed in nanoseconds if need be or to be discharged fully in similar times cannot be achieved and would not be expected. With respect to the ability of the electrophotographic medium to respond fully to radiant energy in nanoseconds, this is essential to a high speed film. Known photoconductive materials have extremely slow transit times, either because of the thickness of the required layers or because of the nature of the material. It requires highly intense light to achieve a large volume of carriers, even when assisted by external power sources; hence speeds of the general order of 500 to 1000 A.S.A. cannot be achieved. Further, one could not expect to be able to read electrostatic images from such materials with electron beams because the time for discharge of the surface charge is too great.

The transit time of the carriers in passing through the photoconductive layer of the electrophotographic medium of the invention is less than the carrier lifetime thereby sustaining the electric field during carrier travel. Further, the entire bulk of the photoconductive layer is depleted during use thereby ensuring uniform transit of carriers without any variations because of zones of opposite energy states. For example, if the carriers are electrons, as in the preferred example, there are no holes which form as a zone to make transit difficult.

Because of the ability of the electrophotographic layer to respond with extremely high speed and the sensitivity produced because of the external power supply producing a large volume of carriers, the medium can respond to the most minute amount of light to produce large numbers of carriers in a short time. Ideally the exposure time should be the time that it takes for the bulk of carriers to move through the thickness of the photoconductive member. In practice this time is of the order of at least microseconds. The speed of the electrophotographic medium under typical conditions has been calculated to be of the order of 30,000 A.S.A. using an approximation.

The electrophotographic medium of the invention preferably uses as its carrier modulating portion a cadmium sulfide film constructed as disclosed in said U.S. Pat. No. 4,025,339, but other electrophotographic films having the general attributes could be utilized to achieve the benefits of the invention.

SUMMARY OF THE INVENTION

According to the invention, a multilayered sandwich is prepared which comprises a modulating structure and a storage structure that are intimately joined by an interface. Each structure includes a conductive layer which is in intimate engagement with the structure. A low voltage of the order of 60 volts d.c. is applied to the sandwich between the two conductive layers. While this voltage is applied, the sandwich is exposed to a pattern of radiant energy such as light through one or the other of the conductive layers, preferably a transparent substrate that backs up the modulating structure. The pattern causes the functioning of the modulating layer as a result of which charges appear at the interface and are transferred and bound to the dielectric layer forming a part of the storage structure. Thereafter, the conductive layer of the storage structure is stripped off leaving the remainder of the sandwich with the charged dielectric layer.

The time of exposure to the pattern of radiant energy is most efficiently chosen to be the average transit time of the carriers from the ohmic layer to the interface between the photoconductive layer and the dielectric layer. This time will depend upon the intensity of the radiant energy being transmitted through the electrophotographic medium and hence can be related to a measurement of this value. Apparatus including the electrophotographic medium preferably will have the power circuit controlled by a switch that is closed for exposure by means of a signal whose duration is related to the measured intensity of radiation. For example, a photoresponsive element in the path of a light pattern projected onto the electrophotographic medium is used to produce a suitable signal which can operate a high speed electronic switch for a time which is determined by the values of the components of a comparing circuit whose response is adjusted with regard to a reference signal.

Once the exposure has been completed, the switch is opened, the two electrodes are momentarily grounded and the latent image is retained on the dielectric layer. It is clear that there is no shutter required for the apparatus, nor is it necessary that the medium remain in darkness until used because the photoconductive layer is never charged.

If desired the latent image on the dielectric layer can be developed by toning or reading the latent image with an electron beam at the time of the removal of the electrode or shortly thereafter. There is no need to separate the dielectric layer therefrom. The toning is applied to that surface of the dielectric layer from which the electrode has been stripped. Otherwise, the sandwich can be stored for a long period of time and the latent charge image will not be dissipated because of the insulating qualities and storage characteristics of the dielectric layer.

A practical embodiment of the invention is made up of thin layers or coatings carried on a substrate, and as such quite flexible and easily handled. The modulating structure is electrophotograhic film of the kind described in U.S. Pat. No. 4,025,339, issued May 24, 1977 to M. R. Kuehnle and assigned to the assignee of this invention. There is a transparent, polyester substrate of a fraction of a millimeter thickness; an ohmic layer of indium/tin oxide sputter-deposited on the substrate in a thickness of about 100 to 500 Angstroms; a layer of pure, crystalline, highly ordered, uniform morphology, dense cadmium sulfide or other similar wholly inorganic, photoconductive material sputterdeposited in a thickness of from 2000 to about 8000 Angstroms on top of the ohmic layer and in some instances doped for specific spectral response characteristics; a layer of dielectric material such as for example silicon nitride ($Si_3N_4$), silicon dioxide ($SiO_2$), aluminum oxide ($Al_2O_3$) ($Ni_3O_4$), magnesium fluoride ($M_gF_2$) or the like, deposited as for example by sputtering in a thickness of between 1000 and 3000 Angstroms on top of the photoconductive layer; and a removable metal electrode engaged on top of the dielectric layer with an intervening layer of some conductive fluid such as a stable electrolyte. The electrode could be a simple metal plate of copper or silver or brass and the electrolyte an inorganic or organic solvent. Brine or an aqueous solution of a conductive polymer of the type used to render paper conductive would be suitable.

An alternative and preferred electrode is one which is formed of any of the low melting point metals known as fusible alloys such as Wood's metal which is readily and quickly liquified at relatively low temperatures above room temperature and solidified at room temperatures. The assembly including the modulating structure and the layer of dielectric material is brought close to a member having a shoe that is capable of being heated, a fusible alloy band being introduced between the shoe and the surface of the dielectric layer. When the medium is to be imaged, the heating elements of the shoe are energized, liquifying the fusible alloy and establishing extremely intimate contact between the shoe and the dielectric layer. The shoe is electrically connected to the voltage source, the other side of the voltage source being connected to the ohmic layer, the control switch intervening in the circuit. After imaging, the shoe is cooled, either by deenergizing the heating elements alone or by so doing and simultaneously cooling the same through the use of circulating coolant in suitable manifolds in the shoe.

After imaging, the shoe is moved away from the dielectric member surface and the now solidified metal peels off without in any way affecting either the physical integrity of the dielectric material and its surface or the charge which has been applied through imaging.

Thereafter, the latent image can be read from the dielectric member by an electron beam or toned and developed. The fact that the electrode has been removed makes the toning a simple matter, the toned image being readily transferred if desired.

A spaced electrode with reversed polarity may be applied to the sandwich to neutralize slow drifting carriers after removing the electrode.

DESCRIPTION OF THE PREFERRED EMBODIMENTS

Figure 1:
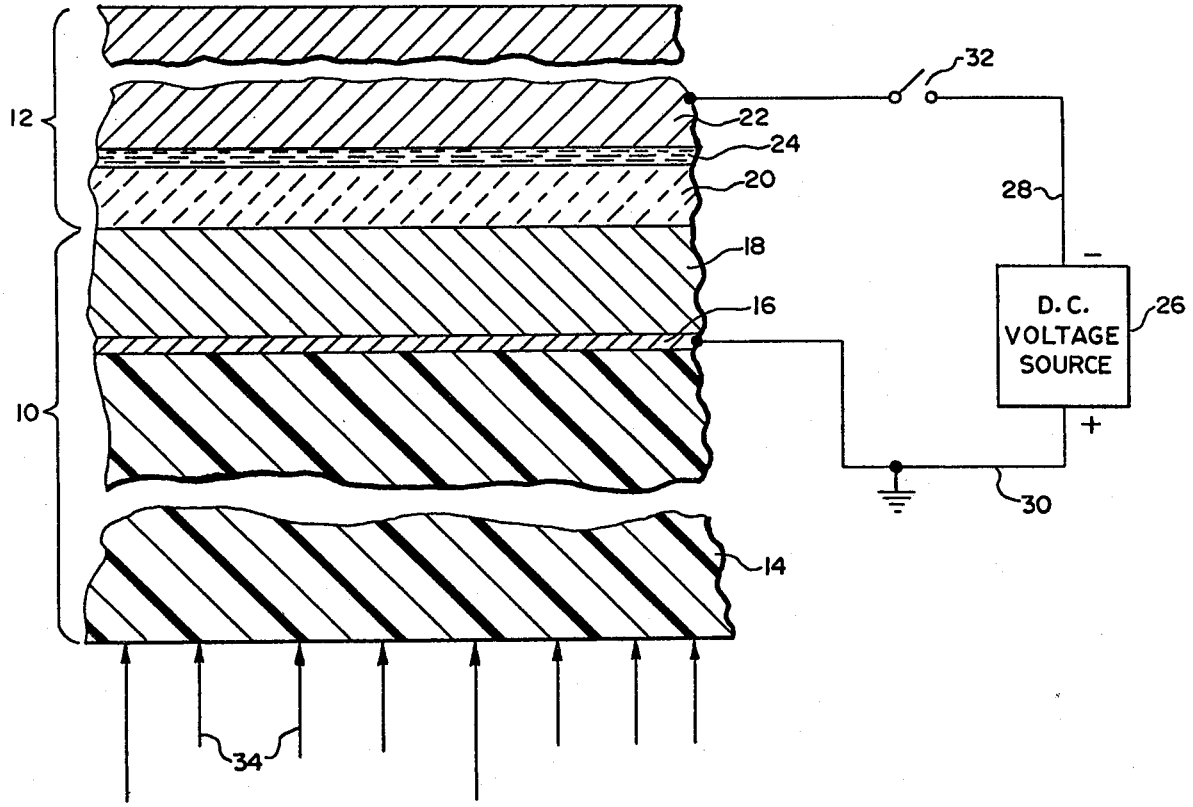
FIG. 1 is a diagrammatic fragmentary sectional view through an electrophotographic medium illustrating the invention connected in a basic arrangement for use.

The invention lies in the structure of the electrophotographic medium and the method for producing images which are claimed and as well in certain apparatus which includes the medium in combination through the use of which the maximum benefits of the invention are realized. The examples which are detailed and the theories of operation are not intended as limiting but only as an aid in understanding the invention.

The basic concept of the invention is concerned with a modulating structure, field and current producing means, a storage structure and time control means. The modulating structure is responsive to radiant energy such as light to provide selective distribution of charge throughout the structure. The field and current producing means comprise an external current source that gives the necessary carriers for movement and establishes a driving field of constant intensity. The storage structure stores the image resulting from proper use of the invention. The time control means comprises switching means responsive to the conditions of the incident radiant energy for controlling the operation of the modulating structure to achieve optimum results. The time control means are operated by use of a radiant energy measuring device that is adjusted to take into account the properties of the modulating structure.

In the course of carrying out this concept, the sensitivity of the modulating structure when compared with its use in any previous manner has been so increased that the equivalents of A.S.A. ratings in the thousands have been achieved. In one example detailed below, it is shown how the A.S.A. rating of a practical example of the electrophotographic medium of the invention is used to achieve an A.S.A. rating of the order of 30,000. This, of course, is completely outside of the scope of any known electrophotographic medium and even beyond the extent that sensitivity and speed which can be achieved with any known photographic medium.

When considering the ordinary electrophotographic medium, the photoconductive receptor of the medium has to be charged and this provides a surface potential which, with the resulting carriers in the medium, form the only basis for synthesizing an electrostatic image. The number of carriers is limited and the driving force decreases with time, being relatively low in any event. Even in the high gain electrophotographic medium of U.S. Pat. No. 4,025,339, referred to above, the maximum surface potential utilized is of the order of 30 to 40 volts and this potential decreases in darkness slowly, making the need for imaging as soon after charging as possible to have the benefit of the largest available electric field.

In the electrophotographic medium of the invention there is a fixed voltage connected between the ohmic layer and the electrode on top of the dielectric layer which furnishes a constant driving force, but more importantly which furnishes an almost infinite source of carriers capable of being utilized to create the desired latent image. The driving force is substantially greater than that which can be achieved through the use of the electrophotographic film consisting only of the photoconductive layer and ohmic layer backed up by the substrate, this latter film comprising the modulating structure of the medium of the invention. Further, the storage capabilities of dielectric material are greatly improved over those of even the best of photoconductive materials so that retention of the resulting latent charge image is very substantially increased. For example, a latent image may be retained for perhaps a few minutes on some of the well-known photoreceptors before its quality starts to deteriorate. The electrophotographic medium of the invention can retain images in high quality for months without deterioration.

Mention has been made of the fact that high speed silver halide films achieve their speed at the expense of grain size which is a result of the processing, among other reasons. In the case of the invention resolution of the image developed from a latent charge image is in no way related to the speed of the medium but is dependent upon the size of the particulate matter which is contained in the toner used or the diameter of the electron beam used to read the image electronically. This is because the type of photoconductive material which is preferably used to form the electrophotographic medium is a crystalline material that has individual field domains produced by crystallites that are less than a tenth of a micron in diameter thereby establishing the smallest line pair resolution of which the material is capable—namely 10,000 line pairs per millimeter.

The general effect of the phenomena which occur in the invention can be likened to amplification, where the carriers released by the photoconductive material are moved in a more efficient manner and in substantially greater amounts than in the case the photoconductive material were used without the dielectric layer on top and without the constant external d.c. voltage connected across the same.

In FIG. 1 there is illustrated an embodiment of the invention during use thereof which comprises the modulating structure 10 and the storage structure 12.

The modulating structure is not greatly different from an electrophotographic film which is disclosed in said U.S. Pat. No. 4,025,339. As a matter of fact, the film which is made for strict electrophotographic use according to the disclosure of said U.S. Patent is completely suitable for use in the invention herein. The modulating structure 10 comprises a substrate 14 which is a sheet of polyester about a fraction of a millimeter in thickness and readily available commercially as manufactured by such chemical manufacturing companies as Celanese, DuPont, Kalle and the like. It is flexible and transparent and quite stable. As described in said U.S. Patent, there is an ohmic layer 16 deposited on the upper surface of the substrate 14 by sputtering techniques, this ohmic layer being preferably of the order of 100 to 300 Angstroms in thickness and also being transparent. It is preferably formed of a mixture of indium and tin oxide in the ratio of nine to one, respectively.

The photoconductive layer 18 is also deposited by sputtering and is laid down in a thoroughly bonded condition onto the surface of the ohmic layer as a thin film of the order of 3000 to 10,000 Angstroms thick. Even thinner films could be used in this invention. It is required in this application to be transparent to a degree which does not substantially block the radiant energy that is intended to be projected through it, for example visible and ultra violet light, and yet it should be capable of absorbing sufficient of the radiant energy to cause the selective release of carriers. As mentioned in the said U.S. Patent, the degree of absorption of the radiant energy can be between 15 and 30%. Obviously the ohmic layer and substrate should absorb as little of the radiant energy as possible.

The preferred material for the layer 18 is pure cadmium sulfide for many reasons, not the least important of which is its panchromaticity. A fall off of response in the red end of the visible spectrum can be compensated for by selective doping if desired. When deposited the cadmium sulfide is crystalline in composition with crystallites that are very uniform and highly ordered in a vertical direction, that is perpendicular to the plane of the substrate surface. The crystallites are hexagonal, about 600 to 800 Angstroms in diameter, result in a highly dense deposit with the boundaries between crystallites so tight as to have substantially no effect as insulating barriers. The surface of such a deposit is electrically anisotropic and has a surface resistivity of the order of $10^{20}$ ohms per square due to the formation of a barrier layer. Dark decay is such that normal use of such a film enables it to be charged and not imaged for hours thereafter. This characteristic is nonetheless of sufficient speed to require certain precautions to be taken in the event that the electrophotographic medium of the invention is not going to be developed immediately after imaging, as will be explained hereinafter.

The dark resistivity of the photoconductive layer 18 is about $10^{13}$ ohm centimeters laterally in the bulk and its light resistivity in the same dimension is about $10^8$ ohm centimeters. This dimension, described as "laterally" is parallel to the plane of the surface of the substrate. This ratio of $10^5$ is of importance in the bulk of the photoconductive layer because of the manner in which the material is used in the invention. The same ratio exists between the resistivity of the cadmium sulfide layer 18 in light and darkness transversely in the bulk, that is perpendicular to the plane of the surface of the substrate. This is an important characteristic in order to assure the production and transport of substantial numbers of carriers and the differentiation between those portions which are affected by photons and those which are not.

When the modulating structure 10 has been completed or prepared a dielectric layer 20 of insulating material is deposited thereon. This layer is preferably about 1000 to 3000 Angstroms thick and may be formed of an inorganic material that is capable of being sputtered so that the same equipment may be used to sputter the same as used for the ohmic layer 16 and the photoconductive layer 18. Several chemicals can be used including insulating silicon oxides such as $SiO_2$ and SiO, silicon nitride ($Si_3N_4$), aluminum oxide ($Al_2O_3$) and the like. The deposit of the layer 20 should be carried out in such a manner as to provide complete and intimate bonding. Sputtering will assure this as could vapor deposit if feasible for the particular substance.

After the dielectric layer 20 has been laid down the article is ready to be used. A key consideration is the fact that there is required to be an electrode 22 serving as a capacitor plate which must be used in order to provide the fixed field for moving the carriers, this electrode 22 being removable according to the invention. The storage structure 12 includes the electrode 22 although the electrode 22 and the dielectric layer 20 are separable and may not even be brought together until the electrophotographic medium is ready for use. It is important that the electrode be in place when the medium is being used to produce an image; hence its inclusion as part of the storage structure.

In FIG. 1 the electrode 22 is a thin plate or band of some metal such as aluminum, copper, steel or the like. It is laid on top of the dielectric layer with an intervening film 24 of conductive material. This film 24 is required to provide the physical conductive interface or connection between the electrode 22 and the dielectric layer 20 and should be as thin as possible. In FIG. 1 the film is formed of a liquid which could be as simple as a saline solution so that it conducts properly, possibly containing a wetting agent of some kind that is miscible with the saline solution so that the surface tension of the liquid is lowered for better wetting and intimate contact. One of the liquids which could also be used is a conductive organic solvent such as the type of liquid polymer used to make paper conductive when producing zinc oxide paper for electrophotographic use. One example is Merck Conductive Polymer 261 in aqueous solution.

In order to use the electrophotographic medium 10, 12 a d.c. voltage source 26 in the form of a simple battery or the like is connected between the electrode 22 and the ohmic layer 16 by means of the leads 28 and 30, there being a switch 32 in the lead 28. The lead 30 may be at ground potential which is convenient for making connection with the ohmic layer 16. A pattern of radiant energy such as a light scene as indicated by the arrows 34 is projected through the bottom surface of the substrate and through the substrate 14, the ohmic layer 16 and the photoconductive layer 18. The switch 32 is closed for the time that exposure is to be made, this time being of the order of microseconds or even nanoseconds if desired or required. During this period of time there will be a selective movement of carriers which, in the case that the photoconductive layer is cadmium sulfide or other N-type material, will comprise electrons. These electrons will move toward the ohmic layer 16 leaving the interface between the photoconductive layer 18 and the dielectric layer 20 more positive where increments were subjected to the impingement of radiant energy and less positive, that is, remaining negative where increments were not subjected to radiant energy. In other words, if the radiant energy 34 comprises visible light, the light increments at the surface of the photoconductive layer 18 would be positive while the dark increments could be negative. They could be neutral as well assuming that there was absolutely no movement of electrons at all.

It can be realized that in the case of normal use of the modulating structure 10 as an electrophotographic film, the film would be charged negative on its surface, the projected light would cause transit and recombination of the electrons so that the light increments would become positive while the dark increments would remain negative. This, then would form the latent image in the same manner as in the case of the electrophotographic medium of the invention except that a substantially greater number of carriers would be available in the case of the invention.

Figure 6:
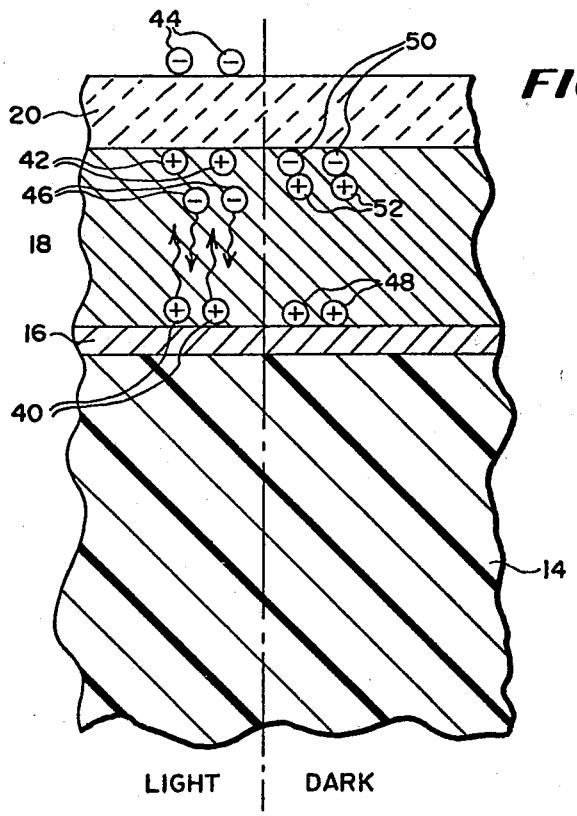
FIG. 6 is a fragmentary sectional view through a portion of the electrophotographic medium used in explaining the operation of the invention and a theory supporting the same.

One can consider the electrical effect as described by saying that positive charges move toward the interface between the photoconductive layer 18 and the dielectric layer 20 but the fact of the matter is that in the case of N-type material such as cadmium sulfide there are no mobile holes as such. These immobile "holes" may be considered positive energy states whose conditions are affected by the movement of the carriers, which in this case comprise electrons. In FIG. 6, the effect of closing the switch is illustrated in the electrophotographic medium in two zones, one being light and the other darkness.

In the light zone, there are shown two positive charges at 40 which seem to move from the ohmic layer 16 toward the dielectric layer 20 to come to rest at 42 on the bottom of the layer. As a result of their presence, an equal and opposite charge is induced through capacitor action on the opposite surface of the dielectric layer 20 indicated by the negative charges 44. In actuality, however, the movement was that of the only mobile carriers, namely the electrons. Thus, two electrons 46 are shown moving toward the ohmic layer 16. The effect of this movement was to leave more positive increments in the interface between the photoconductive layer 18 and the dielectric layer 20, believed to be in the barrier layer of the photoconductive layer 18.

Where there is darkness, we see the positive charges at 48 and the negative charges at 50 which have not moved. Assuming that these negative charges 50 were linked to positive charges 52 and thereby neutralized, there would be no charge at all at the interface and hence none on the surface of the dielectric layer in the dark zone. Relative to the high negative charge at 44 the uncharged increment in darkness is positive, but whatever the situation, there is a substantial charge gradient between the dark and the light increments which will be stored because the dielectric material has infinite resistivity on its surface as well as throughout its bulk with no leakage, normally.

After exposure, the electrode 22 is lifted off the dielectric layer 20 and by capillary action because of the film 24 being quite thin (of the order of a few hundred Angstroms, ideally) most of the liquid of the film 24 will also be lifted off. A blast of air can blow off that which remains, which, being nominal has no effect.

Since the dielectric material is an insulator, as explained, the charges are captured just as they would be in an efficient capacitor or on the surface of an efficient insulator. These charges are selectively distributed in accordance with the distribution of radiant energy projected through the medium. Furthermore, they will remain in place as an integrated image for long periods of time—as much as several months without deteriorating. Thus, several of the articles could be kept in a camera and exposed over a period of time with the images lasting until the articles are removed from the camera for processing.

The thinness of the medium and including the dielectric layer render the same quite flexible and capable of being stored in a cartridge in rolled form and dispensed therefrom, being moved into position to be exposed and the electrode 22 laid onto the dielectric layer 20. The liquid 24 could be automatically dispensed from the same cartridge as the article is dispensed from the cartridge.

In the development of the latent charge image any suitable technique can be used. This includes the reading of the information by electron beam, toning the surface and fixing the developed image directly onto the surface to make a transparency, toning the image and transferring the toner, etc. In cases where the development is not effected immediately, precautions may have to be taken to prevent the image from being altered by drifting carriers in the photoconductor which persist after the switch 32 has been opened. This will be explained below in connection with FIG. 5.

There is some criticality in the timing of the switch 32 which is to be considered in building apparatus for the use of the medium 10, 12. It is essential that the latent charge image be formed in the most efficient manner and this requires that the maximum of carriers reach the interface between the dielectric layer 20 and the photoconductive layer at the same time. If the electric current is cut off by opening the switch 32 before that occurs the image will not be fully formed; if the electric current is permitted to flow after that occurs, carriers will continue to be moved after the image has formed and the image will be swamped. If the switch 32 is held in closed position long enough, the entire image will be lost in fog since the entire surface of the photoconductor will pick up charge without discrimination as a condenser fully charged.

The thinness of the photoconductive layer 18 of the modulating structure 10 is such that there is an extremely short transit time. This time as a general rule will be microseconds or nanoseconds. Thus, the average time of transit of the carriers is chosen to be the time that the switch 32 is closed and this will be the time of exposure. There will only be one length of duration for a given image which is the optimum, this length of duration varying with the conditions of exposure, that is, the intensity of the radiant energy, the spectral response of the photoconductor, the relative intensity of the different parts of the pattern, and perhaps other factors such as temperature and the like. Good results can be expected, however, with variations of an order either way.

In order to achieve this precise time, the switch 32 is preferably operated by automatic means, such as electronic switching circuits. The radiant energy is sampled by means of a photoresponsive device, for example, and provides a signal that is compared with a reference signal to achieve a third signal that operates the switch. This technique and apparatus for practicing the technique are disclosed in U.S. Pat. Nos. 3,864,035 and 3,880,512. Application of this technique to the instant invention is explained in connection with FIG. 4 hereinafter.

Figure 2:
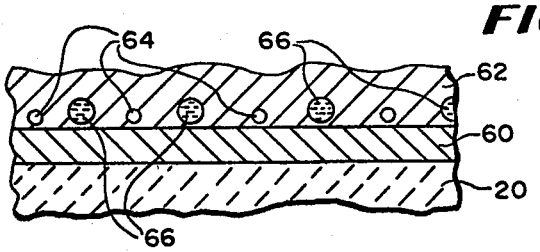
FIG. 2 is a fragmentary sectional view similar to that of FIG. 1 but illustrating a modified form of the invention.

In FIG. 2 there is illustrated a modification of the invention which differs from that of FIG. 1 only in the construction of the electrode 22 and the film 24 and the resulting change in the method of the invention.

The dielectric layer 20 is here shown with a film 60 that is the equivalent of the film 24 but is of metal. By using any of the conductive low melting point metals known as fusible alloys, such as for example Wood's metal, intimate contact can be ensured between the electrode 62 and the dielectric layer 20 if the film 60 is molten before the exposure is made. Thus, the electrode 62 may be arranged to have a bond or strip of the solid metal laid along its lower surface much in the form of a shoe with a band on it. When the article comprising the substrate 14, ohmic layer 16, photoconductive layer 18 and the dielectric layer 20 is ready to be used, it is placed in position and the shoe brought into position on the upper surface of the dielectric layer 20. Heating elements 64 contained in the shoe 62 are energized electrically melting the metal on the bottom of the shoe 62 to form the liquid film 60. This film 60 establishes completely intimate contact between the shoe-electrode 62 and the surface of the dielectric layer 20. Whether the liquid metal solidifies slowly thereafter or not is of no consequence so long as the intimate contact is retained. If desired, the heating elements 64 may be kept energized during the exposure step.

The exposure takes place by closing the switch 32 for a time duration that ideally is the average transit time for the carriers to pass through the photoconductive layer 18 and reach the dielectric layer 20 and thereafter the film 60 is permitted to solidify or the shoe-electrode may have conduits or manifolds 66 capable of carrying coolant therein to cause the molten metal film 60 to solidify. The electric current in the heating elements 64 has in the meantime been discontinued. After the film 60 solidifies the shoe electrode 62 is lifted off the upper surface of the dielectric layer 20. It has been found that if the film 60 does not come off directly with removal of the shoe-electrode 62 it is easily and cleanly capable of being peeled off the surface of the dielectric layer 20 since it has very low affinity for the insulating surface of 20, certainly much less than it has for the metal of the shoe-electrode.

The bottom of the shoe-electrode 62 may be made out of the fusible alloy and used over and over again, the alternate melting and solidifying having no effect on the efficiency of the apparatus. An alternate form would be a heating pot disposed above or slightly to the rear of the location where the electrophotographic medium is to be exposed. The pot deposits a layer of the fusible alloy onto the surface of the dielectric layer. Exposure takes place by means of a slit and the electrophotographic medium is moved away from the pot carrying the thin layer of solidified metal with it, this layer thereafter being raised as by tilting the remaining part of the medium downward, it being quite flexible, and fed back into the pot.

From the above discussion, one can appreciate that since there is no preliminary charging, there is no need to keep the electrophotographic medium in darkness and hence no need for a shutter or any structure to provide for blocking light at any time. In a suitable imaging device such as a camera or duplicator the projected pattern can be directed against the bottom of the substrate 14 at all times. Nothing will happen until the switch 32 is closed and only so long as it is closed. This is an ideal situation because it permits the apparatus for using the electrophotographic medium 10, 12 to be extremely simple.

Figure 3:
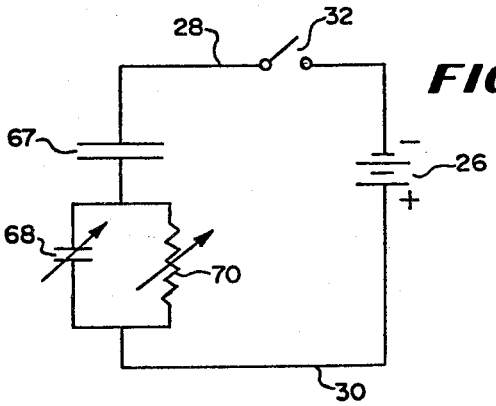
FIG. 3 is a highly simplified circuit diagram of the electrical equivalent of the basic electrophotographic medium of the invention.

In FIG. 3 there is illustrated a simple diagram showing the theoretical equivalent of the structure of the invention. The dielectric layer 20 acts as a condenser 67 to store charge which will run into the condenser depending upon the values of the other elements of the system. The condenser 68 and variable resistor 70 represent the effect of light and darkness on the photoconductive member, changing the impedance of which provides the selective pattern of carriers. The voltage of the source 26 moves these carriers at a rate and to the extent that is permitted by the relative impedance of the elements.

Figure 4:
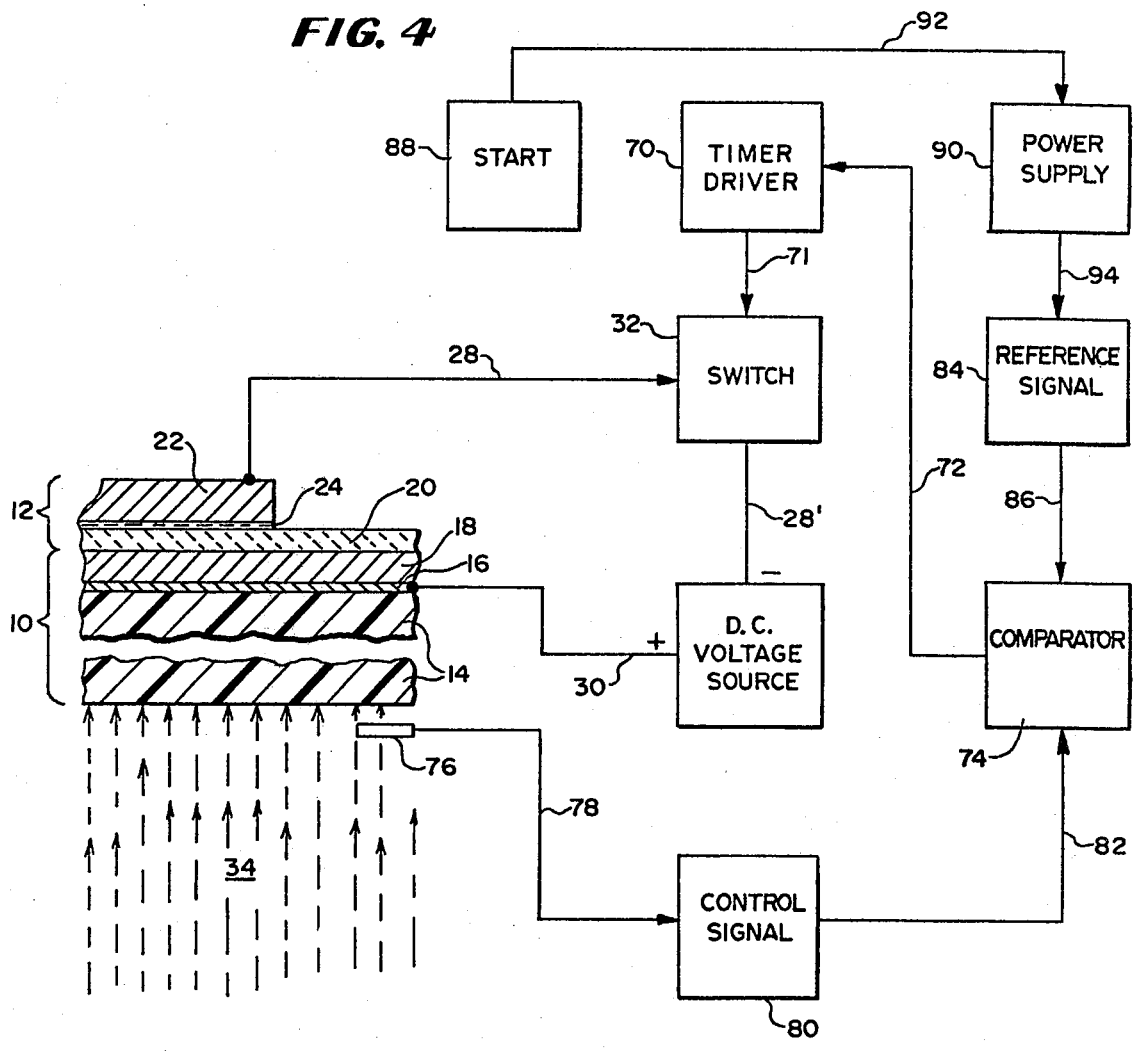
FIG. 4 is a simplified block diagram of apparatus used in connection with the invention to provide a practical system for utilizing the invention.

As pointed out above, the ideal exposure time is related to the degree of radiant energy to which the electrophotographic medium is exposed. The properties of the medium must also be taken into consideration. In FIG. 4 there is illustrated a block diagram which represents apparatus for carrying out the mandate of the requirement that the time of exposure be as nearly equal as possible to the average transit time of the carriers produced.

The switch 32 in this case is an electronic switch which is operated by a timer driver circuit 70 that turns it on and off through line 71 at a particular time depending upon the nature of the signal on the control line 72 coming out of the comparator 74. There is a photoresponsive device 76 which intercepts a small portion of the radiant energy 34 to sample it. This is a transducer which produces a change in current or voltage that appears on the channel 78 leading to the control signal device 80. This control signal device can be adjusted for various conditions to provide a first signal at 82 that is fed to the comparator 74. A reference signal that may be adjusted for various conditions of the electrophotographic medium is produced in a circuit 84 and applied to the comparator 74 through the line 86.

This circuitry is merely suggestive and can readily be worked out to achieve the desired end, namely—to provide a timing signal that will close the switch 32 for a time duration that will give the best exposure for the conditions of the incident radiant energy 34. This is done in U.S. Pat. No. 3,880,512 in a slightly different manner. In that patent, the average light of an image of scene is used to control the degree of charge of an electrophotographic film or the charging level is fixed and the amount of light varied. In the invention herein, the time of exposure is controlled in the preferred version since there is no charging of the film, the field and carrier driving voltage being constant. The adjustments required are made for the particular characteristics of the photoconductor and to be certain to get the desired comparison signal from the photoresponsive device sampling the radiant energy.

In the apparatus of FIG. 4, the process may be started manually by a switch or push button 88 that turns on the power supply 90 through the line 92, this power supply energizing all of the electrical components of the apparatus through suitable connections, generally and symbolically indicated at 94. The apparatus will turn itself off by means of the timer driver 70 that times the duration and turns the switch 32 on and off at the appropriate instants.

Figure 4A:
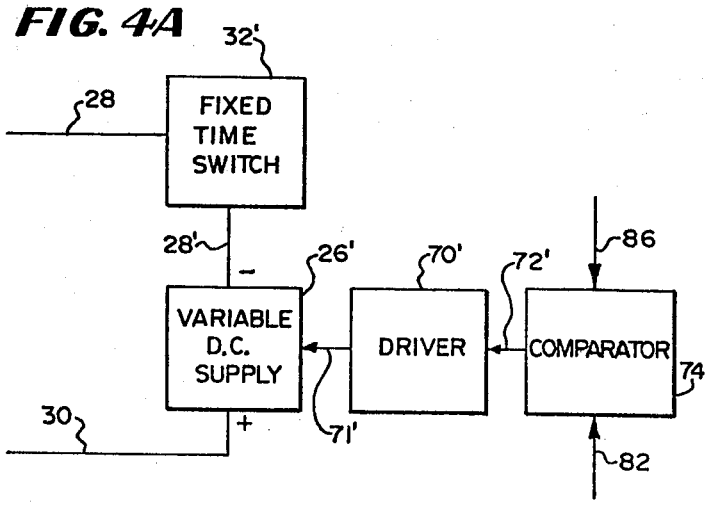
FIG. 4A is similar to FIG. 4 but shows only a portion of the block diagram for a modified form of control.

An alternate form of circuitry would have the blocks shown in FIG. 4A, all other parts of the apparatus being the same as in FIG. 4. Here, instead of varying the duration of exposure, a suitable fixed duration is chosen which is within the range expected for the particular kind of photoconductor and the conditions under which it will be used, and instead the d.c. voltage is varied for the changes in radiant energy. Thus, the switch 32' is a fixed time duration closing switch. When energized it will automatically close for a fixed time and then automatically open, the exposure taking place during this fixed duration. The comparator 74 receives the same signals and makes a comparison to provide an output signal on the line 72' which now extends to a driver 70' that in turn automatically adjusts the voltage of the variable d.c. supply 26' through the channel 71'. The same effect is achieved, that is, the exposure duration is adjusted to be as close as possible in time to the average transit time of the carriers. For higher intensities of radiant energy the voltage will be lower than for lower intensities of radiant energy. The driver 70' may simply furnish power to a small motor driving the slider of the potentiometer of a voltage divider.

Where the latent charge image is immediately read out by electronic scanning there is no problem with carriers that have not completed their transit, and there will always be some of those. If the image is to be stored, however, the dark decay characteristic of the photoconductive layer 18 will continue to move those slow carriers towards the surface of the layer 18. If there are enough of these drifting carriers they will cause deterioration of the latent image as they arrive. It should be recalled that the field for movement of carriers is still present internally, however slow the movement may be. Accordingly, after the image has been established and the electrode 22 has been removed, another electrode 90 is moved over the dielectric layer 20 but is spaced therefrom. A reverse voltage, i.e., having an opposite polarity relative to the voltage used during exposure is applied. Thus, for an N-type material such as cadmium sulfide the ohmic layer will now be connected to a negative terminal of a power supply while the electrode 90 is positive. Electrons will tend to flow in the opposite direction thus neutralizing those carriers as electrons which were moving towards the ohmic layer leaving positive charges. This will have no effect upon the image which is carried on the dielectric layer surface because there is no contact with the electrode 90 and there is an intervening air gap.

Figure 5:
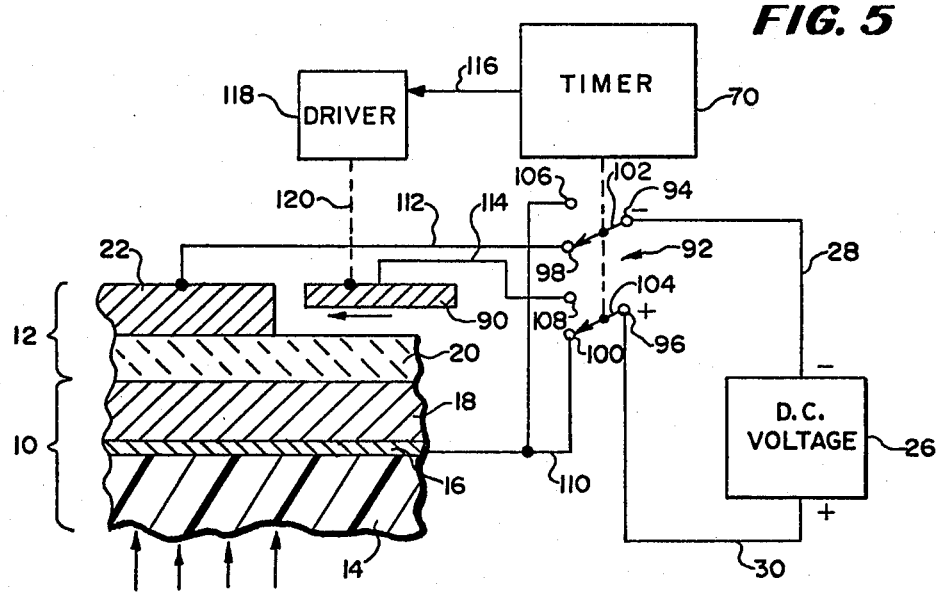
FIG. 5 is a simplified block and symbolic diagram illustrating a modified form of the invention.

In FIG. 5 the timer 70 represents a circuit somewhat like that of FIG. 4 and is shown to represent the fact that the exposure of the medium occurs in a timed manner by connecting the voltage source 26 as indicated in FIG. 1, for example. A ganged switch 92 is shown having the two poles 94 and 96 connected respectively to the negative line 28 and the positive line 30. The contacts 98 and 100 are engaged by the switch arms 102 and 104 during exposure, but as soon as the switch is thrown to the other contacts, these arms 102 and 104 engage the contacts 106 and 108, respectively reversing the polarity. The contacts 106 and 100 both connect through the line 110 to the ohmic layer 16. The contact 98 connects through the line 112 to the electrode 22. The contact 108 connects through the line 114 to the electrode 90.

The apparatus is required to move the electrode 90 into position mechanically after the electrode 22 has been removed and this can be done automatically by the same timing device 70 that operates the switch 92. The line 116 energizes a driver 118 that has a mechanical connection 120 with the electrode 90 to move the same.

A computation of the A.S.A. rating of an electrophotographic article of the invention using cadmium sulfide as the photoconductive layer is made hereinafter.

A daylight scene on a cloudy day shows a highlight illumination of 200 candles/foot$^2$. In deep shadows, the illumination is about 1% of this value or 2 candles/foot$^2$.

Tests made on a typical electrophotographic film where the photoconductive material is pure cadmium sulfide of about 3500 Angstroms thickness have shown that through a lens opening of 1:8 the resistance of the cadmium sulfide will vary from $1.1\times10^3$ ohms/cm$^2$ for highlights to $1.1\times10^5$ ohms/cm$^2$ in the shadows. This test involves using the film as a photocell.

If the dielectric layer 20 has a capacitance C of $2\times10^{-8}$ farads/cm$^2$, which is typical of the materials mentioned, the time constant RC will be $$T=2.2\times10^{-5} \text{ second in highlights}$$

and $$T=2.2\times10^{-3} \text{ second in shadows.}$$

At an exposure time of 33 microseconds, the factor t/RC (t=time of exposure) is $$1.5 \text{ for highlights } e^{-t/RC}=0.223$$

and $$0.015 \text{ for shadows. } e^{-t/RC}=0.985$$

During the exposure time, which incidentally has been chosen as a rough estimate of the average transit time for carriers through the photoconductor layer, the capacitor of which the structure 10,12 is the equivalent, will charge. The voltage V attained is computed by the formula $$V=V_0(1-e^{-t/RC})$$

where $V_o$ is the applied d.c. voltage across the condenser plates (16 and 22) and e is the Napierian constant.

Under the assumed conditions the dielectric layer 20 will charge to 0.77 $V_o$ in the highlights
and
0.015 $V_o$ in the shadows.

Using the assumptions made above, it is estimated that in order to get the same response from a silver halide black and white film under the light conditions given, its A.S.A. rating would have to be of the order of 30,000. No such film is known, so far as we are aware.

Incidentally, it should be clear from the above that the time of exposure, that is, charging time of the equivalent capacitor must be such that the factor of t/RC must be between zero and unity, preferably as close to unity as feasible. Transit time across the cadmium sulfide can be approximated by the mobility of the carriers multiplied by the thickness of the layer 18, assuming that the distance travelled is the full thickness.

As mentioned, the layer 18 is preferably cadmium sulfide in its pure sputtered condition, having the attributes of the material disclosed in said U.S. Pat. No. 4,025,339. Doping with carbon, copper, or other substances will enable varying the spectral response and even increasing the quantum gain in certain cases. Other substances can also be used as the photoconductive layer, such as zinc sulfide (ZnS) and mixtures of zinc sulfide and cadmium sulfide; zinc telluride (ZnTe); arsenic trisulfide ($As_2S_3$); zinc selenide (ZnSe); zinc indium sulfide ($ZnIn_2S_4$); cadmium selenide (CdSe); cadmium telluride (CdTe); gallium arsenide (GaAs); and antimony trisulfide ($Sb_2S_3$).

Variations in thickness of the several layers can be made as well without leaving the scope of the invention. The dielectric layer 20 may be quite thin, i.e., less than 1000 Angstroms if desired. It serves additionally as a protective cover for the photoconductive layer and should be deposited very uniformly. Thick layers, i.e., 1000 Angstroms and up are easier to deposit.

It has been described above that the apparatus of the invention requires no shutter inasmuch as there will be no production of carriers until the simultaneous occurrence of the projection of the radiant energy through the electrophotographic medium and the establishment of the connection with the voltage source 26. Thus, in making an image, one need only keep the scene or pattern of radiant energy projected upon the medium and close the switch for the desired time. This is the preferred method because it eliminates the need for shutter and mechanisms to drive the shutter. It is, however, quite feasible to utilize shutters and shutter mechanisms such as for example, those which may be in the possession of the user and control the time of exposure thereby. In such case, the switch 32 would be closed for a period before the image is to be projected, remaining closed until after the image has been projected. The shutter is then adjusted to expose the film to the scene for the period of time desired, say for example, a thousandth of a second ($1\times10^{-3}$) or less. The electrophotographic medium will otherwise remain in darkness.

The claims should be interpreted with the understanding that both of the methods may be used, that is, the shutterless preferred method and the method of exposure using a shutter. The constructed apparatus can be used in either manner.

From the above it will be seen that the invention can be used under adverse light conditions to produce images which are readily available for development. As an example, aerial cameras can make high resolution photos of the terrain at high speeds at light levels no greater than moonlight without using complex shutters and lens systems. Many other uses will suggest themselves to those skilled in this art.

What it is desired to secure by Letters Patent of the United States is:

1. An electrographic medium adapted to be imaged by a particular type of radiant energy to achieve at least a latent electric charge image of a pattern of said radiant energy, said medium comprising:

A. a modulating structure consisting of:
   i. a substrate that is transparent to said radiant energy,
   ii. an ohmic layer of a thin film material deposited onto a surface of said substrate in a thickness to be transparent to said radiant energy, and
   iii. a thin film photoconductive layer of a wholly inorganic, microcrystalline, uniformly ordered and vertically oriented crystallite, dense material having a dark resistivity of at least about $10^{12}$ ohm centimeters, a ratio of dark to light resistivity of at least about $10^4$, a thickness of a degree to enable the transmission of said radiant energy with less than about 30% absorption of white light, said crystalline layer being bonded to the surface of said ohmic layer opposite the substrate, B. a storage structure consisting of
   i. a layer of dielectric material that is highly insulating electrically, intimately and permanently bonded to the surface of the photoconductive layer opposite the ohmic layer,
   ii. an electrode overlying the dielectric layer on the surface opposite the photoconductive layer, and
   iii. an interfacing, intimately connecting conductive film between the electrode and the dielectric layer, said film being of a nature to enable ready separation of the electrode from the dielectric layer, C. means for extending a connection from each of said ohmic layer and electrode to a relatively low voltage d.c. source and D. said electrophotographic medium adapted to have said pattern projected against the bottom of the substrate, through the substrate and ohmic layer and into said photoconductive layer whereby selectivity to release charge carriers for modulated movement through said photoconductive layer to effect the synthesization of said projected pattern onto the surface of the photoconductive layer opposite the ohmic layer and thence by induction through and onto the surface of said dielectric layer.

2. The electrophotographic medium as claimed in claim 1 in which the conductive film comprises a liquid of conductive material disposed between the electrode and the dielectric material.

3. The electrophotographic medium as claimed in claim 1 in which the modulating structure and the dielectric layer are highly flexible.

4. The electrophotographic medium as claimed in claim 1 in which the substrate is flexible polyester sheeting a fraction of a millimeter thick and the combined thickness of the ohmic layer, photoconductive layer and dielectric layer is substantially less than one micron whereby to render the medium highly flexible without the electrode.

5. The electrophotographic medium as claimed in claim 1 in which the conductive film comprises a fusible metal alloy and the electrode includes means for enabling the heating of the electrode to melt the metal under control to establish the intimate connection, said fusible metal alloy when solidified being readily separable from said dielectric layer.

6. The electrophotographic medium as claimed in claim 1 in which the photoconductive layer is formed of a sputter-deposited, N-type material, the charge carriers are electrons, and the thickness of the photoconductive layer is such that the average transit time of the carriers through the photoconductive layer is less than their average lifetime.

7. The electrophotographic medium as claimed in claim 1 in which the photoconductive layer is sputter-deposited cadmium sulfide of high purity but for dopant, if any.

8. The electrophotographic medium as claimed in claim 1 in which the photoconductive layer is sputter-deposited cadmium sulfide of high purity but for dopant, if any, having a thickness which is between about 1000 and 8000 Angstroms; the ohmic layer is an oxide of principally indium sputter-deposited and having a thickness between about 100 and 500 Angstroms; the substrate is polyester having a thickness that is a fraction of a millimeter; and the dielectric layer is an inorganic material of a thickness greater than about 500 Angstroms but substantially less than a micron.

9. The electrophotographic medium as claimed in claim 1 in which the photoconductive layer is cadmium sulfide of high purity but for dopant, if any; the ohmic layer is principally indium oxide; and the dielectric layer is an inorganic material from the group comprising magnesium fluoride, silicon dioxide, aluminum oxide and silicon nitride.

10. The electrophotographic medium as claimed in claim 1 in which the photoconductive layer is sputter-deposited cadmium sulfide of high purity but for dopant, if any, and having a thickness which is about between 1000 and 8000 Angstroms; the substrate is polyester film having a thickness of about a fraction of a millimeter; the ohmic layer is sputter-deposited indium-tin oxide between about 100 and 500 Angstroms thick; and the dielectric layer is silicon nitride about 500 to 3000 Angstroms thick.

11. The electrophotographic medium as claimed in claim 5 in which the electrode includes means for cooling the electrode to solidify the metal under control.

* * * * *